United States Patent [19]

Peche

[11] Patent Number: 4,567,338

[45] Date of Patent: Jan. 28, 1986

[54] CUP-SHAPED SWITCH CONTACT MEMBER FOR AN ELECTRIC VACUUM SWITCH

[75] Inventor: Gerhard Peche, Romrod, Fed. Rep. of Germany

[73] Assignee: Siemens Aktiengesellschaft, Berlin and Munich, Fed. Rep. of Germany

[21] Appl. No.: 625,721

[22] Filed: Jun. 28, 1984

[30] Foreign Application Priority Data

Jun. 30, 1983 [DE] Fed. Rep. of Germany ..... 3323627

[51] Int. Cl.[4] ..... H01H 33/66

[52] U.S. Cl. ..... 200/144 B; 200/279

[58] Field of Search ..... 200/144 B, 179

[56] References Cited

U.S. PATENT DOCUMENTS

| | | | |
|---|---|---|---|
| 4,149,050 | 4/1979 | Gorman et al. | 200/144 B |
| 4,334,133 | 6/1982 | Gebel et al. | 200/144 B |
| 4,438,307 | 2/1984 | Lippmann et al. | 200/144 B |
| 4,445,015 | 4/1984 | Zueckler | 200/144 B |

*Primary Examiner*—Robert S. Macon

*Attorney, Agent, or Firm*—Herbert L. Lerner; Laurence A. Greenberg

[57] ABSTRACT

Cup-shaped switch contact member for an electric vacuum switch having a lead post, a bottom connected to the lead post, a cylinder wall connected to the bottom, and a contact ring secured to the cylinder wall and formed of a material favoring interruption of an arc and having a lower conductivity than that of the cylinder wall, the lead post having a diameter smaller than the inner diameter of the cylinder wall, the cylinder wall and the contact ring being at least partly slotted, the slots formed in the cylinder wall extending at an angle to the axis of rotation of the switch contact member and merging with the slots formed in the contact ring, including a contact surface formed on the contact ring and having a pair of concentric annular zones overlying respective radially inner and radially outer marginal regions of an annular end face of the cylinder wall, the contact surface also having a middle annular zone disposed between the concentric annular zones and being farther removed from the cylinder wall than either of the concentric annular zones, a layer of the material of the contact ring having a thickness approximately equal to a depth of maximum melting occuring during switch-off or disconnection of the switch contact member, the layer being disposed in vicinity of the slots formed in the contact ring and extending continuously along the contact surface without being slotted, the contact ring being of such thickness as to be able to absorb maximum bending forces occurring during closing or switch-on of the switch contact member without impermissible deformation.

15 Claims, 3 Drawing Figures

CUP-SHAPED SWITCH CONTACT MEMBER FOR AN ELECTRIC VACUUM SWITCH

Figure 1:
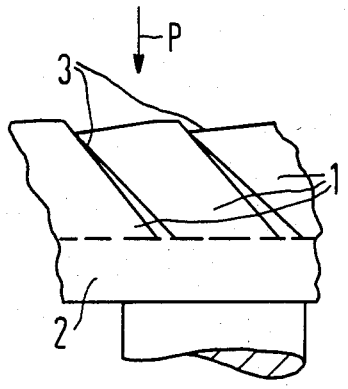
FIG 1 PRIOR ART

The invention relates to a cup-shaped switch contact member for an electric vacuum switch and, more particularly, to such a switch contact member having a lead post, a bottom connected to the lead post, a cylinder wall connected to the bottom, and a contact ring secured to the cylinder wall and formed of a material favoring interruption of an arc and having a lower conductivity than that of the cylinder wall, the lead post having a diameter smaller than the inner diameter of the cylinder wall, the cylinder wall and the contact ring being at least partly slotted, the slots formed in the cylinder wall extending at an angle to the axis of rotation of the switch contact member and merging with the slots formed in the contact ring.

Such a switch contact has become known heretofore from U.S. Pat. No. 4,149,050. According to this patent the contact ring is first soldered to a lip-shaped rim part of the cup contact which adjoins the cylinder wall in axial direction and projects beyond the cylinder wall in raidal direction, is slotted together with the cylinder wall in soldered-on condition, closed again by hammering and subsequently fused together, so that a continuous surface of the contact ring is produced again. Such contacts have an overdesigned contact area for a thickness of the cylinder wall adequate for the mechanical stress; the resistance in the circumferential direction is relatively low and the resistance in the axial direction relatively high. This favors an undesirable stopping of the rotation of the electric arc.

The slotted cylinder wall is at least partly subdivided by the slots into legs extending at an inclined angle to the axis of rotation of the contact member. During the closing or connecting process in the vacuum switch, these legs are stressed or loaded in axial direction by very large mechanical forces. These forces, which are caused by the inrush current, can amount to several 1000 N. In addition to compression, these forces also cause bending of the individual legs towards the side thereof suspended or projecting beyond the bottom of the cup. In this regard, the overhanging parts of the legs tilt or tip in a direction towards the bottom of the cup and cause bending of the contact ring which is very thin in the vicinity of the slots. Apart from this, the connection location over the slots, which was formed, for example, by hammering and subsequent fusion, is non-uniform and of low strength, and otherwise not specifically known. The danger therefore exists that the contact ring will break open during operation, for example, in the switch-off or disconnect process and, thus, the switch-off or disconnect capacity upon the occurrence of a short circuit is no longer assured.

Due to the bending of the legs, the ring surface is deformed in sawtooth-fashion and the contact rings of the two contacts of a vacuum switch lie on top of one another only in certain locations in the closed or switched-on position of the vacuum switch. Danger of a sudden fixation of the arc thereby exists.

To circumvent these disadvantages and to increase the switching capacity, U.S. Pat. No. 4,348,307 proposed that a contact ring be put on, the electrical conductivity at the transition from the contact carrier to the contact ring being supposed to decrease by at least a factor of three. This non-slotted contact ring assures the necessary mechanical strength and, due to its low conductivity, is supposed also to assure the rotation of the arc and thereby to increase the switch-off or disconnect current.

From U.S. Pat. No. 4,334,133, a cup contact with a non-slotted contact ring is known wherein the contact surface is composed of frustroconical rings and, therefore, is approximately dome-shaped. According to this last-mentioned patent, the contact ring is mechanically strong enough, but has a relatively large conductivity in the circumferential direction.

It is accordingly an object of the invention to provide a cup-shaped switch contact member wherein the electrical resistance decreases in the main current direction of the contact ring and increases in the circumferential direction of the contact ring, and wherein rotation of the arc is assured.

With the foregoing and other objects in view, there is provided, in accordance with the invention, a cup-shaped switch contact member for an electric vacuum switch having a lead post, a bottom connected to the lead post, a cylinder wall connected to the bottom, and a contact ring secured to the cylinder wall and formed of a material favoring interruption of an arc and having a lower conductivity than that of the cylinder wall, the lead post having a diameter smaller than the inner diameter of the cylinder wall, the cylinder wall and the contact ring being at least partly slotted, the slots formed in the cylinder wall extending at an angle to the axis of rotation of the switch contact member and merging with the slots formed in the contact ring, comprising a contact surface formed on the contact ring and having a pair of concentric annular zones overlying respective radially inner and radially outer marginal regions of an annular end face of the cylinder wall, the contact surface also having a middle annular zone disposed between the concentric annular zones and being farther removed from the cylinder wall than either of the concentric annular zones, a layer of the material of the contact ring having a thickness approximately equal to a depth of maximum melting occurring during switch-off or disconnection of the switch contact member, the layer being disposed in vicinity of the slots formed in the contact ring and extending continuously along the contact surface without being slotted, the contact ring being of such thickness as to be able to absorb maximum bending forces occurring during closing or switch-on of the switch contact member without impermissible deformation.

In accordance with another feature of the invention, the slots formed in the contact ring extend in the same direction of rotation as those of the cylinder wall.

In accordance with a further feature of the invention, the slots formed in the contact ring extend axially parallel to the contact surface.

In accordance with an additional feature of the invention, the contact surface has a dome-shaped cross section.

In accordance with an added feature of the invention, the pair of concentric annular zones have respective frustoconical shapes, and the middle annular zone is planar.

Inasmuch as the non-slotted layer follows the convexity of the contact surface, it forms a profile with a relatively slight wall thickness and relatively great profile height. By the profile height there is meant the largest dimension of the projection of the profile in the radial direction. In the event compressive stress is applied in the direction of the axis of rotation of the switch contact, this is no longer stressed flexually or in bending with the narrow slots used therein, but is rather stressed in shear. The shear strength of such a profile is considerably greater, however, than the bending strength of a planar layer with the thickness and width of the profile wall. A contact ring according to the invention, with slot widths which are producible, for example, by conventional circular saw blades thereby assume a resistance to axial pressure which is not appreciably reduced and, at the same time, a considerably increased electrical resistance in the circumferential direction.

The cross section of the contact ring may advantageously be a circular segment. In such a case, the slots can be produced very simply by a circular saw blade, the diameter of which is appropriately matched therewith. Advantageously, the contact surface is formed in a zone of mean thickness of the contact ring, with a planar annular zone perpendicular to the axis of the contact ring. Shapes which are relatively simple to form are obtained if the cross section of the approximately domed contact surface is composed of several straight sections. In such embodiments, the slots can be approximated by a circular arc which has the same minimum spacing from all surfaces. High strength is achieved by the invention also in the case of especially thin non-slotted layers.

A suitable embodiment of the invention includes a contact ring with a maximum thickness of about 4 mm, a planar annular zone about 10 mm wide, disposed in a plane perpendicular to the axis of the contact ring, the total width of the contact ring being about 20 mm. By the contact ring width, there is means half the difference between the outside diameter and the inside diameter of the contact ring.

The invention can also be applied advantageously to cup contacts formed with slots such as are described in the aforementioned U.S. Pat. No. 4,334,133.

In accordance with yet another feature of the invention, the middle annular zone of the contact surface is located in a region of mean thickness of the contact ring and is a planar annular zone disposed in a plane perpendicular to the axis of the contact ring.

In accordance with yet a further feature of the invention, the contact surface has an approximately dome-shaped cross section formed of a plurality of planar sections.

In accordance with yet an additional feature of the invention, the slots formed in the contact ring are narrower than the slots formed in the cylinder wall.

In accordance with yet an added feature of the invention, the contact ring has additional slots formed therein which are as narrow as possible beyond the slots formed in the cylinder wall. A further increase of the resistance in the circumferential direction of the contact ring is achievable by providing this last-mentioned feature.

In accordance with an alternate feature of the invention, the material of the contact ring consists of a relatively soft contact material with little brittleness. Thereby, breakage or rupture in the vicinity of the slots is prevented if the pressure should rise suddenly.

In accordance with still another feature of the invention, the material of the contact ring consists of a compound chromium-copper metal having more than 50% copper, and the cylinder wall is formed of copper.

With a compound or composite chromium-copper metal having 80% copper and the remainder chromium, sufficient strength is nevertheless provided, and the contact resistance, on the other hand, is already relatively small, so that only little heating occurs.

In accordance with a concomitant feature of the invention, the contact ring is soldered to the cylinder wall, and the non-slotted layer extends short off the end face of the cylinder wall. The resistance around the slot is thereby increased, especially if the contact ring has a considerably lower conductivity than that of the cylinder wall. Thus, a current in the circumferential direction, which could stop the rotating arc as a result of the magnitude and direction thereof, is avoided.

Other features which are considered as characteristic for the invention are set forth in the appended claims.

Although the invention is illustrated and described herein as embodied in a cup-shaped switch contact member for an electric vacuum switch, it is nevertheless not intended to be limited to the details shown, since various modifications and structural changes may be made therein without departing from the spirit of the invention and within the scope and range of equivalents of the claims.

Figure 2:
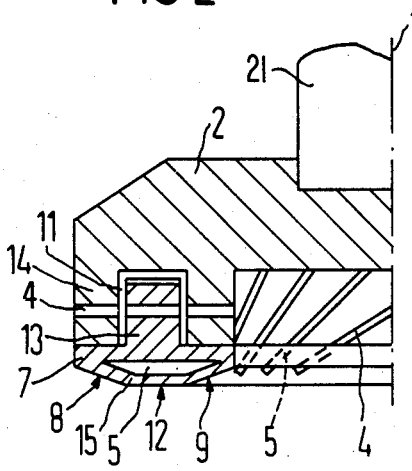
Figure 3:
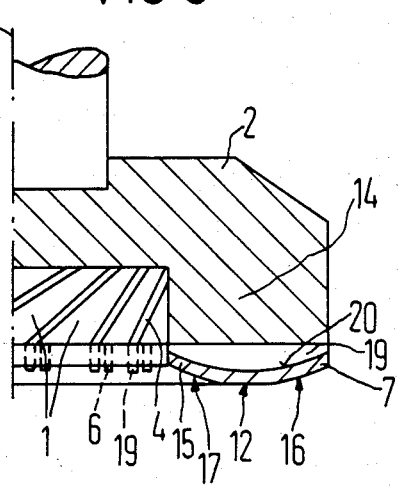

The construction and method of operation of the invention, however, together with additional objects and advantages thereof will be best understood from the following description of specific embodiments when read in connection with the accompanying drawings, in which:

FIG. 1 is a fragmentary broken-away elevational view of a cup contact according to the prior state of the art; and FIGS. 2 and 3 are respective left-hand and right-hand half-sectional views of two different embodiments of the cup contact according to the invention.

Referring now to the drawing and, first particularly to FIG. 1, there is shown therein a conventional cup contact with contact legs which, due to the application of contact pressure in the direction P, are upset and the respective corners 3 thereof extending beyond the contact bottom 2 of a lead post 21 are bent towards the contact bottom. An approximately sawtooth-shaped surface is thereby formed. A non-illustrated contact ring is likewise bent in the process if it has only approximately the thickness which can be melted in the disconnect process. Such a contact ring can also break easily if bent, so that interruptions occur.

The embodiment of the invention according to FIG. 2 shows a contact ring 7 with a contact surface which is composed of two frustroconical ring regions 8 and 9 and a planar ring region 12, the latter region 12 being disposed in a plane which is perpendicular to the axis of rotation 10 of the cup contact. Slots 5 formed in the contact ring 7 leave over a non-slotted layer 15 toward the contact surface, the thickness of which corresponds at least approximately to the maximum melting thickness during the disconnect process. The profile of the slots 5 matches or conforms to the profile of the contact area. The maximum melting thickness is that layer thickness which is liquefied when the breaking arc occurs at maximum current.

This liquefaction of the non-slotted layer 15 does not lead to any impermissible weakening of the switch contact, because this melting occurs only during opening i.e. disconnection, and more specifically at a time when the contact surface is not loaded by any mechanical pressure.

The slanted or inclined slots 5 formed in the contact ring 7 merge into the slanted slots 4 formed in the cylinder wall 14. The two groups of inclined slots 4 and 5 need not have the same angle of inclination to the axis of rotation 10.

The cylinder wall 14 is formed with a groove 11 and the contact ring 7 has an annular part 13 which is received in and fills the slot 11. The annular part 13 is also subdivided by the slots 5. The annular part 13 may be formed of relatively poorly conductive hard material and serves then for additionally transmitting the mechanical load to the contact bottom 2. This construction additionally offers the advantages known from U.S. Pat. No. 4,334,133 of a particularly desirable guidance of the arc on the contact ring 7.

FIG. 3 shows an embodiment of the invention having a non-grooved cylinder wall. The contact surface is made up of a planar ring zone 12 in vicinity of the middle diameter of the contact ring 7 and two adjoining convex ring parts 16 and 17. A slot 19 extends over the entire width of the contact ring 7.

Advantageously, the intersection angle of the slots 5 formed in the contact ring 7 with the axis of rotation 10 can be a smaller angle than the intersection angled of the slots 4 formed in the cylinder wall 14 with the axis of rotation 10. The direction of extension of the slots is thereby matched to the direction of the main current which forms a smaller angle with the axis of rotation 10 in the material with a lower conductivity and, thus, the resistance in the direction of the main current is reduced. In FIG. 3, the slots 6 and 19 extend approximately parallel to the axis of rotation 10, so that the slot 19 extends, in the illustrated cross-sectional view, up to the apex of the non-slotted layer 15. The profile of the latter has a circular arcuate end face 20 having like spacing to the ring zone 12 and to the annular parts 16 and 17.

Besides the slots 5 which adjoin the slots 4 formed in the cylinder wall 14, the contact ring 7 is formed, in this embodiment of FIG. 3, with further slots 6 which additionally increase the resistance in circumferential direction of the contact ring 7.

In this embodiment of FIG. 3, a disturbing current flow around the slots 19 from one leg 1 to the next leg 1 is avoided, because the slots 19 extend over the entire width of the contact ring 7, and the current must therefore flow over a relatively long path in the contact ring 7 which has a lower conductivity than that of the cylinder wall 14.

The foregoing is a description corresponding, in substance, to German application No. P 33 23 627.5, dated June 30, 1983, international priority of which is being claimed for the instant application, and which is hereby made part of this application. Any material discrepancies between the foregoing specification and the specification of the aforementioned corresponding German application are to be resolved in favor of the latter.

I claim:

1. Cup-shaped switch contact member for an electric vacuum switch having a lead post, a bottom connected to the lead post, a cylinder wall connected to the bottom, and a contact ring secured to the cylinder wall and formed of a material favoring interruption of an arc having a lower conductivity than that of the cylinder wall, the lead post having a diameter smaller than the inner diameter of the cylinder wall, the cylinder wall and the contact ring being at least partly slotted, the slots formed in the clinder wall extending at an angle to the axis of rotation of the switch contact member and merging with the slots formed in the contact ring, comprising a contact surface formed on the contact ring and having a pair of concentric annular zones overlying respective radially inner and radially outer marginal regions of an annular end face of the cylinder wall, said contact surface also having a middle annular zone disposed between said concentric annular zones and being farther removed from the cylinder wall than either of said concentric annular zones, a layer of the material of the contact ring having a thickness approximately equal to a depth of maximum melting occurring during switch-off or disconnection of the switch contact member, said layer being disposed in vicinity of the slots formed in the contact ring and extending continuously along said contact surface without being slotted, the contact ring being of such thickness as to be able to absorb maximum bending forces occurring during closing or switch-on of the switch contact member without impermissible deformation.

2. Switch contact member according to claim 1 wherein the slots formed in the contact ring extend in the same direction of rotation towards said contact surface as those of said cylinder wall.

3. Switch contact member according to claim 1 wherein the slots formed in the contact ring extend axially parallel to said contact surface.

4. Switch contact member according to claim 1 wherein said contact surface has a dome-shaped cross section.

5. Switch contact member according to claim 1 wherein said pair of concentric annular zones have respective frustoconical shapes, and said middle annular zone is planar.

6. Switch contact member according to claim 1 wherein said middle annular zone of said contact surface is located in a region of mean thickness of said contact ring and is a planar annular zone disposed in a plane perpendicular to the axis of the contact ring.

7. Switch contact member according to claim 1 wherein said contact surface has an approximately dome-shaped cross section formed of a plurality of planar sections.

8. Switch contact member according to claim 1 wherein the slots formed in the contact ring are narrower than the slots formed in the cylinder wall.

9. Switch contact member according to claim 1 wherein the contact ring has additional slots formed therein which are as narrow as possible beyond the slots formed in the cylinder wall.

10. Switch contact member according to claim 1 wherein the material of the contact ring consists of a relatively soft contact material with little brittleness.

11. Switch contact member according to claim 10 wherein the material of the contact ring consists of a compound chromium-copper metal having more than 50% copper, and the cylinder wall is formed of copper.

12. Switch contact member according to claim 11 wherein the copper content in the contact ring is about 80%.

13. Switch contact member according to claim 1 wherein the contact ring is soldered to the cylinder wall, and the non-slotted layer extends short off the end face of the cylinder wall.

14. Switch contact member according to claim 2 wherein said pair of concentric annular zones have respective frustroconical shapes, and said middle annular zone is planar.

15. Switch contact member according to claim 3 wherein said contact surface has a dome-shaped cross section.

* * * * *